US006316102B1

(12) United States Patent
Sasaki

(10) Patent No.: US 6,316,102 B1
(45) Date of Patent: Nov. 13, 2001

(54) RAYON FIBER WITH ION-GENERATING, CHARACTERISTICS AND A METHOD FOR MANUFACTURING IT

(75) Inventor: Keiji Sasaki, Tokyo (JP)

(73) Assignee: Jewel Power Co., LTD, Tokyo ( * ) Notice: Subject to any disclaimer, the term of this patent is extended or adjusted under 35 U.S.C. 154(b) by 0 days.

(21) Appl. No.: 09/715,685

(22) Filed: Nov. 17, 2000

Related U.S. Application Data

(60) Provisional application No. 60/166,195, filed on Nov. 18, 1999, now abandoned.

(51) Int. Cl.[7] ..... D01F 6/00; D01F 2/00; D01F 2/10

(52) U.S. Cl. ..... 428/364; 428/322; 428/393

(58) Field of Search ..... 428/364, 372, 428/393

(56) References Cited

U.S. PATENT DOCUMENTS 5,601,909 * 2/1997 Kubo ..... 428/372
5,863,653 * 1/1999 Sugihara et al. ..... 428/393
5,981,063 * 11/1999 Yokozeki et al. ..... 428/372

* cited by examiner

*Primary Examiner*—N. Edwards
(74) *Attorney, Agent, or Firm*—Knobbe, Martens, Olson & Bear, LLP.

(57) ABSTRACT

A manufacturing method for rayon having ion-generating characteristics, featuring a ceramic content comprising 10–40% tourmaline by weight, 10–40% serpentine by weight, and 40–80% silica by weight. The ceramics are subjected to dry pulverization processing to achieve particle diameters of 2–10 μm, and then to wet pulverization processing to make ceramic fine particle powder with average particle diameters under 0.5 μm. The ceramic fine particle powder is then mixed as ceramic solids in viscose so that the ceramic content by weight is 15–35% that of cellulose. The viscose is mixed by quantitatively and continuously adding the above dispersion of ceramic in water with a vacuum-sealed agitator device installed in the viscose pipe circuit just prior to spinning of the viscose.

4 Claims, 3 Drawing Sheets

RAYON FIBER WITH ION-GENERATING, CHARACTERISTICS AND A METHOD FOR MANUFACTURING IT

RELATED APPLICATION

This application claims the benefit of U.S. Provisional Patent Application Serial No. 60/166,195, filed Nov. 18, 1999, under 35 U.S.C. § 119 now abandoned.

BACKGROUND OF THE INVENTION

1. Field of the Invention

The present invention relates generally to rayon fibers, and more particularly to rayon fibers with ion-generating characteristics and a method for manufacturing such fibers.

2. Description of the Related Art

Ceramics that radiate far infrared rays, when adhered to clothing, are known to promote blood flow. However, due to the relatively low temperatures of the human body (40° C. or lower), it is difficult for a person's body heat to bring the ceramics to a temperature that is high enough to radiate high levels of far infrared rays. As a result, the effect on the body is minimal. In addition, there were no rayon fibers with antibiotic, deodorant, and far infrared radiation characteristics until a few years ago. Prior to then, washing and dry cleaning often did not remove dirt, smells, and germs from clothing made from mixes of rayon fiber, cotton, and/or synthetic fibers, in particular underwear, sheets, futon covers used at hospitals and other medical facilities, and kitchen utensils. Thus, such materials were non-hygenic. Also, since they did not radiate far infrared rays, they could not raise the temperature of the skin surface and did not promote blood circulation.

Various solutions to these problems have been proposed. One example, disclosed in Japanese Patent Publication Heisei 2-169764 Official Bulletin, is a rayon fiber that has electrotreated fibers with 3–4% tourmaline by weight adhered or impregnated thereon, the tourmaline particles having a diameter of 2 $\mu$m or less. Another example, disclosed in Patent Publication Heisei 4-327207 Official Bulletin, is a rayon fiber impregnated with or having adhered thereon ultra fine tourmaline particles as a ceramic. In this process, the tourmaline particles are mixed with alkali cellulose, carbon disulfide, and caustic soda. The mixture is vacuum kneaded, ripened, and then spun into rayon fibers. Tourmaline is believed to provide a stable electrical charge effect that electrically stimulates the electropotential of the skin surface. The tourmaline radiates stimulating far infrared rays to the skin surface and, through a multiplying effect, improves the body's metabolism and blood circulation.

Also, Patent Publications Heisei 3-215266 Official Bulletin and Heisei 5-98506 Official Bulletin teach public compound ceramics with deodorant and antibiotic characteristics. These ceramics comprise fine magnesia particles used as the base and one of alumina, silica, zinc oxide, titanium, zeolite, serpentine, hornblende, oyastone, or the like mixed in as the additive. These references also teach methods of manufacturing these compound ceramics as well as fibers containing these ceramics.

Rayon fiber is commonly manufactured from cellulose, an inert carbohydrate found in cell walls of plants, wood, cotton, and other materials. In one method, purified cellulose is treated with caustic soda (sodium hydroxide) to form alkali cellulose. After the alkali cellulose has aged, carbon disulfide is added to form cellulose xanthate, which is dissolved in sodium hydroxide. This viscous solution, known as viscose, is forced through spinnerettes, thimble-like devices with tiny holes through which the viscose is pumped to form the rayon fibers. Emerging from the holes, jets of viscose enter a coagulating bath of acids and salts, in which they are reconverted to cellulose and coagulated to form a solid filament. The filament may be manipulated and modified during the manufacturing process to control luster, strength, elongation, filament size, and cross section.

Processes for manufacturing clothing with ceramics having ion-generating characteristics typically involve both dry and wet pulverization of ceramics to create a powder. This dispersion of ceramics (e.g., tourmaline powder) in water is added to alkaline cellulose in a kneader together with carbon disulfide and caustic soda, forming viscose. The viscose, containing the ceramics, is then spun to form rayon fiber.

SUMMARY OF THE INVENTION

One problem with prior art processes for using tourmaline in fabric is that they do not produce good quality viscose. When the dispersion of ceramics in water is added to alkaline cellulose in the kneader, together with carbon disulfide and caustic soda, the alkaline cellulose typically already has the minimum necessary water. Thus, if the water portion of the dispersed solution is added, excess water is retained on the surface of the alkaline cellulose. As a result, the surface of the alkaline cellulose is covered with a film of water molecules, impeding its reaction with the carbon disulfide and making it very difficult to obtain high quality viscose.

Another problem with prior art methods of manufacturing clothing with ceramics is that it is extremely difficult to clean the manufacturing equipment after use. Typically, the ceramics dispersion is processed in stages, such as ripening, filtering, and foam removal. During such multi-stage processing the ceramics solution flows through and adheres to a series of pipes and tanks. When the manufacturing process is complete, it is very difficult to clean the interior of these pipes and tanks.

With particular regard to the use of fine magnesia particles as the substrate, the manufacturing process is too complicated and is not yet practically applicable.

Accordingly, it is a principle object and advantage of the present invention to overcome these problems and to provide improved methods for manufacturing good quality rayon fiber with fine ceramic particles.

In one aspect, the present invention provides rayon fiber comprising cellulose and ceramic content. The ceramic content is formed of a powder comprising 10–40% tourmaline by weight, 10–40% serpentine by weight, and 40–80% silica by weight. In one embodiment, the powder has an average particle diameter of less than 0.5 $\mu$m. In another embodiment, the weight of ceramics in the fiber is 5–15% of the weight of cellulose in the fiber. In yet another embodiment, the powder comprises 15–25% tourmaline by weight, 15–25% serpentine by weight, and 50–70% silica by weight.

In another aspect, the present invention provides a method of manufacturing fibers with ion-generating characteristics, comprising forming viscose substantially without any ceramics; forming a dispersed aqueous ceramics solution; mixing the ceramics solution with the viscose to form viscose containing ceramics; and spinning the viscose containing ceramics into fibers.

In another aspect, the present invention provides a method of manufacturing rayon fibers with ion-generating characteristics, comprising wet pulverizing ceramic powder to form a dispersed aqueous ceramics solution; adding the ceramics solution to cellulose pulp; adding caustic soda and carbon disulfide to the cellulose pulp, to form viscose containing ceramics; and spinning the viscose containing ceramics into fibers. In this method, the ceramic powder comprises 10–40% by weight tourmaline, 10–40% by weight serpentine, and 40–80% by weight silica.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
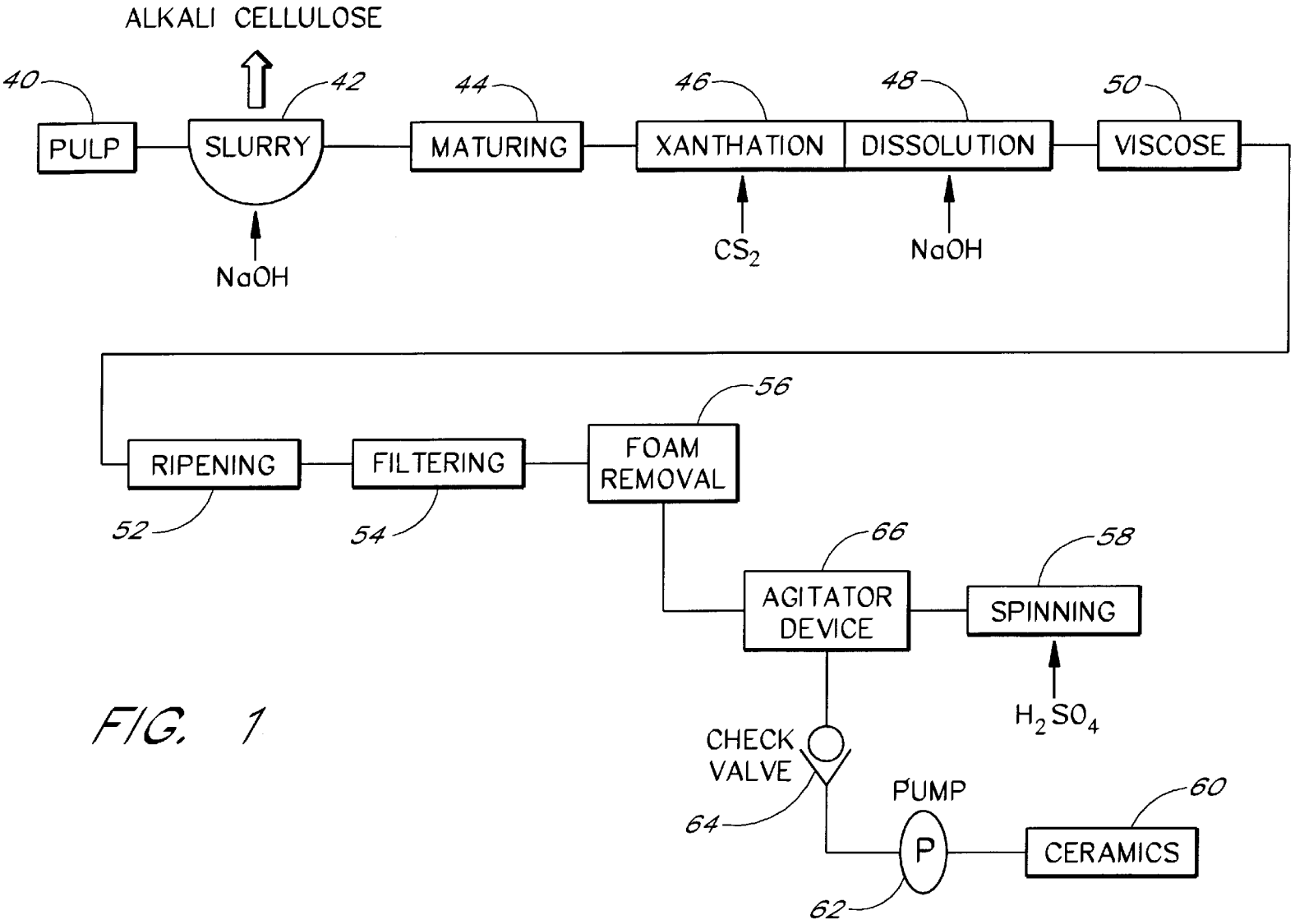
FIG. 1 is an illustration of a process for manufacturing rayon fiber according to a preferred embodiment of the present invention.

The present invention provides rayon fiber with three different ceramic components: tourmaline, serpentine, and silica. This combination of ceramic components provides superior antibiotic, deodorant, far infrared, and electrical characteristics. In the manufacturing process of the present invention, fine ceramic powder is mixed into viscose prior to spinning the viscose into rayon fibers. The ceramic powder comprises the three components tourmaline, serpentine, and silica. In one embodiment, the powder contains only these three components, while in other embodiments other components may be added, such as alumina, zinc oxide, titanium oxide, magnesium, or the like.

Tourmaline is a mineral that has advantageous electrical characteristics, especially when electrotreated. Tourmaline has permanent self-generating polarization, in which the vector for the polarization is not affected by external electrical fields. Also, tourmaline radiates an extremely high level of far infrared rays. Fibers containing tourmaline electrically respond to mechanical shock, which results from contact between fibers or by other causes. When a mechanical shock is felt, the fibers generate a high dimensional electrical current, generating a sufficient electrical field to influence the electropotential of the skin. Through the combined effect of the polarization electrical load and piezoelectricity, as well as the far infrared rays emitted by the tourmaline, the skin's membrane is stimulated. Such stimulation activates the membrane to promote metabolism and blood circulation.

The electropotential of the skin can be lowered by age or fatigue. In general, the electropotential of the skin is about 10 mV. However, if the cells are activated or the membrane is stimulated, active electropotential is generated in the membrane. This electropotential is transmitted through the central nerves and affects the autonomic and voluntary nervous systems. External electrical stimulation of the skin activates the film electropotential of the membrane, promoting metabolism and blood circulation.

Tourmaline also has strong heat characteristics. The higher the temperature of the tourmaline, the higher the polarization load it demonstrates and the greater the piezoelectric ratio. In the present invention, the tourmaline is advantageously heated to a high temperature when it is mixed with viscose during the spinning step of the manufacturing process. Preferably, the viscose and/or the tourmaline are melted. Due to the high temperature, the tourmaline demonstrates extremely good electrical characteristics. The tourmaline also has antibiotic properties against colon bacillie and staphylococcus. Preferably, the tourmaline content of the abovementioned fine ceramic powder is 10–40% by weight, and more preferably 15–25% by weight.

Serpentine has antibiotic properties and is particularly effective against colon bacilli and staphylococcus. Serpentine also has deodorant properties that are particularly effective against ammonia and hydrogen sulfide, which are common causes of unpleasant odors. In the rayon fiber of the present invention, the serpentine supplements the effects of the tourmaline. Preferably, the serpentine content of the ceramic powder of the invention is 10–40% by weight, and more preferably 15–25% by weight.

Silica has powerful deodorizing properties, and is also particularly effective against the effects of ammonia and hydrogen sulfide. Preferably, the silica content of the ceramic powder of the invention is 40–80% by weight, and more preferably 50–70% by weight. Other suitable materials that can be used in place of silica are zeolite, oyastone, petalite, and hornblende, since all of these materials have a powerful deodorizing effect against ammonia and hydrogen sulfide.

According to a preferred manufacturing process of the present invention, a mixture of tourmaline, serpentine, and silica is first dry pulverized to a certain particle size, preferably about 2–10 $\mu$m. Then, the mixture is wet pulverized into fine powder having particle diameters no greater than about 0.5 $\mu$m. The process of wet pulverization results in a dispersion of ceramics in water. This mixture is mixed with viscose prior to spinning the viscose into rayon fiber.

The ceramic content ratio (the solid component within the slurry) of the dispersion of ceramics in water mixed with viscose is preferably 15–35% by weight, and more preferably 20–30% by weight. This ratio was determined by balancing the goals of uniformity of agitating and mixing into the viscose, the adhesion of the ceramics to the obtained rayon fiber, and other parameters. Also, it is desirable that the ceramics be mixed in such a way that the ceramic solids in the viscose comprise 5–15%, and more preferably 8–12%, by weight of the cellulose. In this case, the mixing proportion for the ceramic solids be determined by the desired characteristics of the rayon fiber, and also by the uniformity in mixing. The composition of the viscose is preferably cellulose 10% by weight, water 80% by weight, caustic soda 8% by weight, and carbon disulfide 2% by weight.

According to a preferred embodiment of the present invention, the dispersion of ceramics in water is mixed into the viscose just prior to the step of spinning the viscose into rayon fiber. Preferably, the dispersion is pumped into the viscose pipe circuit and mixed with the viscose by an agitator device installed in the pipe circuit. Advantageously, the ceramic does not flow through most of the pipe circuit of the processing apparatus. Rather, the ceramic enters the pipe circuit just prior to the spinning step. To create rayon fiber with a different ceramic composition, all that is needed is to replace the agitator device and inject a different aqueous ceramic dispersion into the viscose. It is not necessary to clean all of the inside surfaces of the pipes and tanks of the apparatus to ensure that the original ceramic is purged, because the ceramic is added near the end of the manufacturing process. When manufacturing fiber without mixing in a dispersion of ceramic in water, there is no need to activate the agitator device, which poses no obstacle whatsoever to rayon production. Thus, the process of the present invention reduces down time of the apparatus and increases manufacturing efficiency.

The agitator device is preferably sealed, and more preferably vacuum-sealed. Preferably, the agitator device has pressurizing agitator blades on its front side and a porous plate on its rear side. Preferably, the dispersion of ceramic in water is pumped at a constant volume to the front side through a check valve, is pressurized and agitated by the pressurizing agitator blades, and then depressurized and mixed by the rear side porous plate for more complete and uniform mixing.

Manufacturing Methods

The present invention provides two types of processes for manufacturing rayon fiber with ceramic content. In one method, shown in FIG. 1, a specific mixture of ceramic components is mixed with cellulose pulp prior to producing viscose. In another method, shown in FIG. 2, the ceramic content is mixed with viscose just prior to spinning the viscose into rayon fiber.

According to the manufacturing method of FIG. 1, the dispersion of ceramics in water is formed. In one test example, the composition of the compound ceramic was 20% tourmaline by weight, 20% serpentine by weight, and 60% silica by weight. These components are dry pulverized to form a powder having particle diameters of around 2–10 $\mu$m. The powder is then wet pulverized. In the test example, the ceramic solids comprised 25% by weight of the dispersion of ceramic in water, and the average particle size of the ceramics was no greater than 0.5 $\mu$m. This is the dissolution pulp 40, which may also include cellulose.

Next, caustic soda (NaOH) is reacted 42 with the dissolution pulp 40 (dispersion of ceramic in water) to make alkali cellulose slurry. The slurry is matured 44. Then carbon disulfide is added 46 for hardening. Caustic soda is again added 48, and the resulting viscose 50 is agitated and dissolved. After ripening 52, impurities are filtered out 54 and foam is removed 56. The purified solution is sent to a spinning pump and pushed out from the pump nozzle into a spinning tank for spinning 58 into rayon fibers. Here the viscose is solidified and regenerated into cellulose by sulfuric acid in the spinning tank. Of course, other acids may be used. In one embodiment of the present invention, additional ceramics 60, in the form of a dispersed aqueous solution, are added. The ceramics 60 are forced by a pump 62 through a check valve 64 and into an agitator device 66 in the viscose pipe circuit. The ceramics are mixed into the viscose as described above, just prior to spinning 58 the viscose into rayon fibers.

Figure 2:
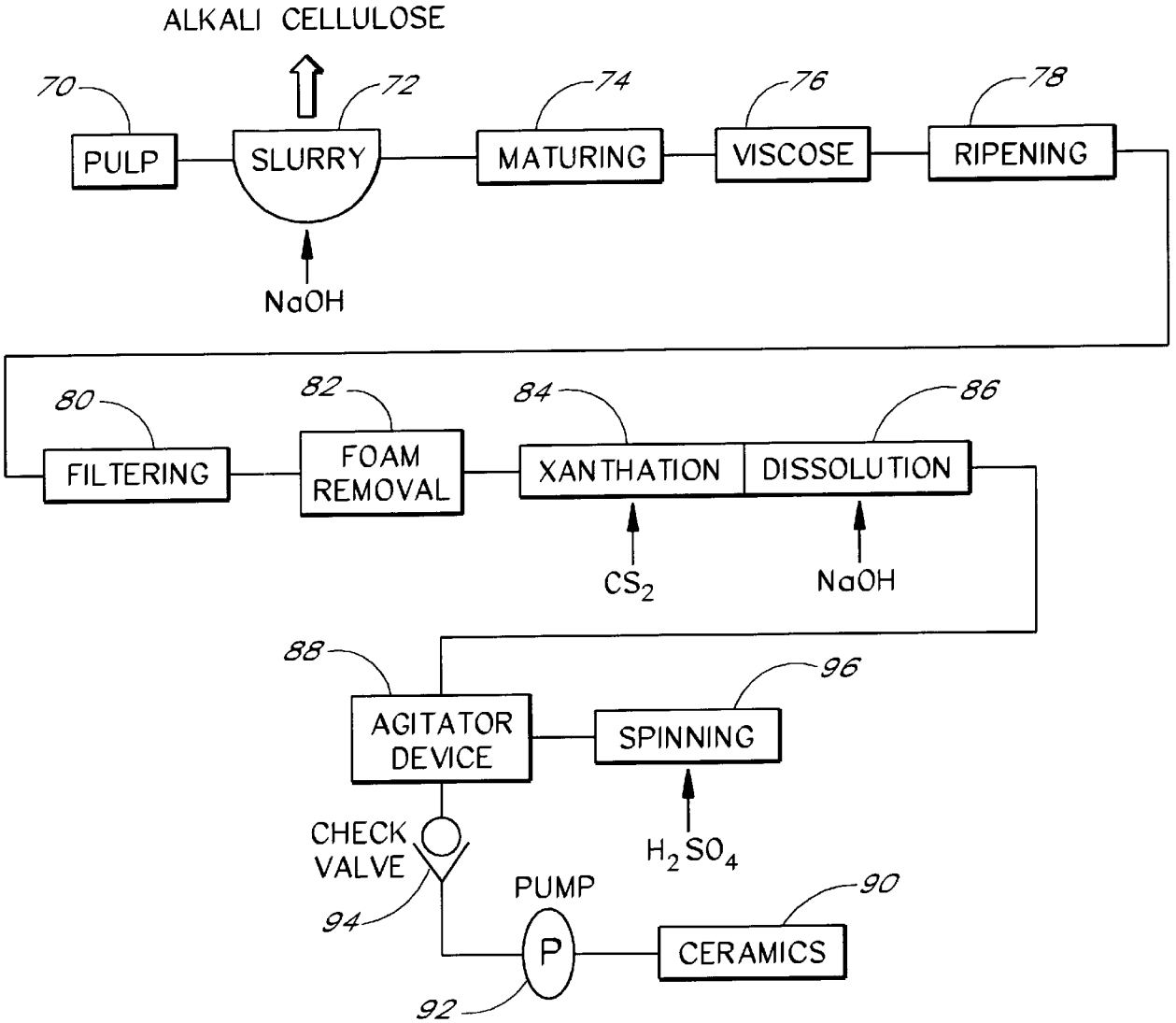
FIG. 2 is an illustration of a process for manufacturing rayon fiber according to another preferred embodiment of the present invention.

FIG. 2 shows the preferred method of the present invention. In this method, a cellulose pulp 70 is formed, without ceramic content. Caustic soda is added 72 to form alkaline cellulose. The slurry is matured 74 to form viscose 76, ripened 78, and filtered 80. Next, foam is removed 82. Carbon disulfide and then caustic soda are added 84 and 86, respectively. The mixture is sent to an agitator device 88 for mixing with ceramics 90. The ceramics 90 are forced by a pump 92 through a check valve 94 and into the agitator device 88, as described above. The mixture of ceramics and viscose is spun 96 to form rayon fibers. In a test example, a 25% by weight dispersion of ceramic 90 in water was added so that the ceramic solids were 10% by weight of the cellulose. Since the cellulose was 10% of the viscose by weight, the ceramic solids were mixed in at a ratio of 1% by weight of the entire viscose.

In the manufacturing method of FIG. 2, since the dispersion of ceramic in water is added 88 just prior to the final process of fiber spinning 96, the ceramic powder has absolutely no effect on any of the manufacturing processes 70–86, making this technique extremely useful. As explained above, the need for cleaning operations to remove the ceramic powder from the manufacturing apparatus has been completely eliminated. It is relatively easy to switch to a different ceramic composition, requiring only replacement of the agitator device 88. Also, if it is desired to manufacture conventional rayon fiber without ceramic content, all that is needed is to remove the manufacturing apparatuses 60, 62, 64, and 66. Another advantage of the manufacturing method of this invention is that, since the viscose is formed independently of the ceramics, it is possible to form higher quality viscose.

Effects of the Ceramics

In the test examples of the manufacturing methods described above, the antibiotic ratio and far infrared radiation ratio were measured for various ceramic components by themselves. Tables 1 and 2 show the results. Table 1 shows the number of live germs and deodorant ratio for the individual ceramic components, and Table 2 shows the average radiation ratio for the individual ceramic components.

TABLE 1

| | Number of live germs (per ml)(Note 1) | | Deodorant ratio (%)(Note 2) | |
|---|---|---|---|---|
| Ceramic | Start | After 24 hours | Ammonia | Hydrogen sulfide |
| Tourmaline | 65,000 | 720,000 | 83 | 44 |
| Serpentine | 65,000 | 18,000 | 89.9 | 100 |
| Silica | 65,000 | 24,000 | 93 | 10 |

(Note 1)The number of live germs is found by adding 0.9 g of the test item to 30 ml of germ reducing phosphate hygienic table salt water, shaking at a storage temperature of 35° C., and measuring the number of germs over time.

(Note 2)The deoderant ratio was found by placing 5 g of the test item (tourmaline, serpentine, or silica) in a smell bag (5 liter capacity), sealing in ammonia (about 80 ppm), and measuring the gas concentration in the smell bag over time. The same test method was used with hydrogen sulfide (about 31 ppm) instead of the ammonia.

Note 1: The number of live germs is found by adding 0.9 g of the test item to 30 ml of germ reducing phosphate hygienic table salt water, shaking at a storage temperature of 35 ° C., and measuring the number of germs over time.

Note 2: The deodorant ratio was found by placing 5 g of the test item (tourmaline, serpentine, or silica) in a smell bag (5 liter capacity), sealing in ammonia (about 80 ppm), and measuring the gas concentration in the smell bag over time. The same test method was 5 used with hydrogen sulfide (about 31 ppm) instead of the ammonia.

TABLE 2

| Ceramic | Average radiation ratio (%) |
|---|---|
| Tourmaline | 94.4 |
| Serpentine | 85.8 |
| Silica | 87.0 |

The average radiation ratios were measured using a JIF-E500 measurement device and MCT detector at a temperature of 35 ° C. with a resolution of 1/16 cm, and with 200 measurements integrated. The radiation ratio is expressed by setting the radiation ratio for a black body to 1, processing a pseudo-black body (since a black body cannot be manufactured), and giving the comparison (as a percentage) of the radiation from the test piece to the radiation from the pseudo-black body.

The characteristics of the compound ceramic that was used in the test examples for this invention are given in Table 3. This ceramic had a composition of 20% tourmaline by weight, 20% serpentine by weight, and 60% silica by weight.

TABLE 3

| | | Number of live germs (per ml) | | Deodorant ratio (%) | |
|---|---|---|---|---|---|
| | Radiation ratio (%) | Start | After 24 hours | Ammonia | Hydrogen sulfide |
| Compound ceramic of this invention | 93 | 65,000 | 290,000 | 40 | 28 |
| Example for comparison (tourmaline alone) | 85 | 65,000 | 720,000 | 30 | 44 |

Note: The measurements of the number of germs and the deodorant ratio used the conditions given in the notes for Table 1.

Note: The measurements of the number of germs and the deodorant ratio used the conditions given in the notes for Table 1.

From the results in Table 3, it can be seen that the multiplier effect for the components that make up the compound ceramic results in a superior far infrared radiation characteristic and also improves the number of live germs and the deodorant ratio.

Tests of the number of live germs and the radiation ratio were conducted for the rayon fiber obtained by adding and mixing in the compound ceramic obtained through the particularly favorable mixing ratio of this invention (conforming to the above manufacturing method). Table 4 shows the test results.

TABLE 4

| | | Number of live germs (per ml) | | Deodorant ratio (%) | |
|---|---|---|---|---|---|
| | Radiation ratio (%) | Start | After 24 hours | Ammonia | Hydrogen sulfide |
| Compound ceramic of this invention | 63 | 40,000 | 0 | 46 | 45 |

Note 1: The number of gerns uses staphylococcus as the example.
Note 2: The measurements of the number of germs and deoderant ratio used the conditions given in the notes for Table 1.

Note 1: The number of germs uses staphylococcus as the example.

Note 2: The measurements of the number of germs and deodorant ratio used the conditions given in the notes for Table 1.

Figure 3:
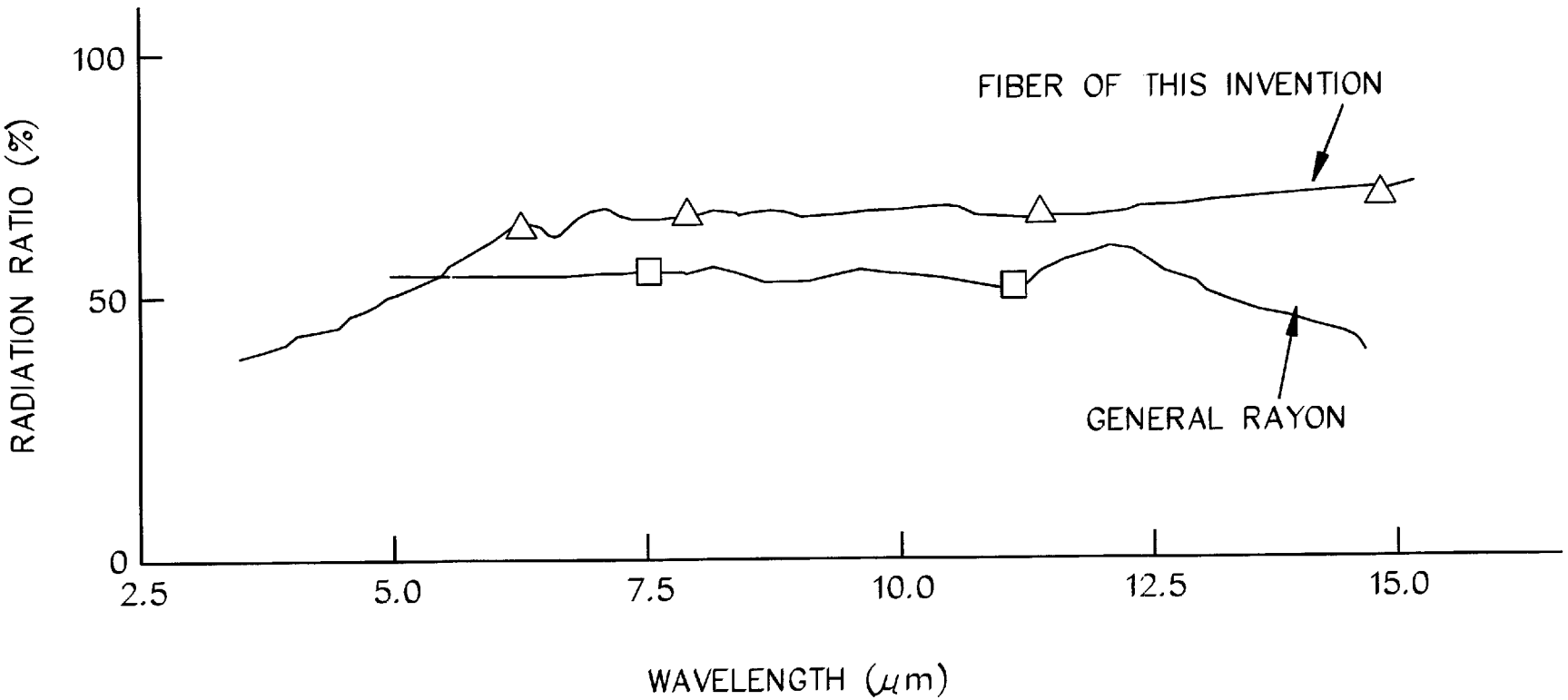
FIG. 3 is a distribution chart showing far infrared radiation ratios for conventional rayon fiber and the rayon of the present invention.

In the above test examples, the far infrared ratio was measured for the obtained rayon fiber. FIG. 3 shows a comparison between the far infrared ration for the rayon fiber of the present invention and the same for conventional rayon fiber. As shown, the far infrared radiation ratio for the rayon fiber of the present invention was found to be generally higher. Thus, compared to conventional rayon, the rayon fiber obtained from the manufacturing method of this invention has a higher far infrared radiation ratio and improved antibiotic and deodorant ratios. The rayon of the present invention is ideal in materials such as fabric, clothing, lining, underwear, blankets, etc. Clothing having woven rayon fibers manufactured according to the methods of the present invention reacts to body heat to increase the far infrared radiation ratio, raising the surface temperature of the skin. The far infrared radiation activates bodily fluids and promotes blood circulation, relieving the effects of fatigue.

Thus, the rayon fiber of this invention has an improved far infrared radiation ratio, antibiotic ratio, and deodorant ratio. In particular, the mixture of tourmaline, serpentine, and silica has the effect of electrically stimulating the electropotential of the human skin and radiating stimulating far infrared rays on the skin's surface. Through the multiplier effect between these stimulations, the rayon fibers of this invention promote metabolism and blood flow in the body and tend to prevent symptoms of coldness, stiff shoulders, and aging. Further, in the rayon manufacturing method of this invention, the ceramics are mixed in the pipe circuit Just prior to the spinning process. This eliminates the problems associated with cleaning the ceramics from the manufacturing apparatus when it is desired to create rayon having a different ceramic composition. As a result, the manufacturing processes can be managed effectively, improving the quality of the manufactured rayon.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. Rayon fiber comprising cellulose and ceramic content, said ceramic content formed of a powder comprising 10–40% tourmaline by weight, 10–40% serpentine by weight, and 40–80% silica by weight.

2. The rayon fiber of claim 1, wherein said powder has an average particle diameter of less than 0.5 $\mu$m.

3. The rayon fiber of claim 1, wherein the weight of ceramics in said fiber is 5–15% of the weight of cellulose in said fiber.

4. The rayon fiber of claim 1, said powder comprising 15–25% tourmaline by weight, 15–25% serpentine by weight, and 50–70% silica by weight.

* * * * *